US011784388B2

(12) United States Patent
Obeidat et al.

(10) Patent No.: US 11,784,388 B2
(45) Date of Patent: Oct. 10, 2023

(54) RECONFIGURABLE ANTENNA WITH A STRANDS ANTENNA RADIATION PATTERN

(71) Applicant: ARRIS Enterprises LLC, Suwanee, GA (US)

(72) Inventors: Khaled A. Obeidat, San Jose, CA (US); Douglas Blake Kough, San Jose, CA (US)

(73) Assignee: ARRIS Enterprise LLC, Suwanee, GA (US)

( * ) Notice: Subject to any disclaimer, the term of this patent is extended or adjusted under 35 U.S.C. 154(b) by 116 days.

(21) Appl. No.: 17/209,276

(22) Filed: Mar. 23, 2021

(65) Prior Publication Data

US 2021/0305715 A1 Sep. 30, 2021

Related U.S. Application Data

(60) Provisional application No. 62/994,862, filed on Mar. 26, 2020.

(51) Int. Cl.

| | |
|---|---|
| ***H01Q 21/24*** | (2006.01) |
| ***H01Q 1/00*** | (2006.01) |
| ***H01Q 19/28*** | (2006.01) |
| ***H01Q 1/22*** | (2006.01) |

(52) U.S. Cl.

CPC ..... *H01Q 1/007* (2013.01); *H01Q 1/2291* (2013.01); *H01Q 19/28* (2013.01); *H01Q 21/24* (2013.01)

(58) Field of Classification Search

CPC ..... H01Q 1/007; H01Q 1/2291; H01Q 19/28; H01Q 21/24; H01Q 21/245; H01Q 3/446

See application file for complete search history.

(56) References Cited

U.S. PATENT DOCUMENTS

| | | | | |
|---|---|---|---|---|
| 8,031,129 | B2 | 10/2011 | Shtrom et al. | |
| 2007/0200781 | A1 | 8/2007 | Ahn et al. | |
| 2011/0032159 | A1* | 2/2011 | Wu | H01Q 21/245 343/893 |
| 2017/0222334 | A1 | 8/2017 | Shtrom et al. | |
| 2022/0029291 | A1* | 1/2022 | Hayes | H01Q 1/287 |

OTHER PUBLICATIONS

PCT Application Serial No. US21/23847, International Search Report and Written Opinion, dated Jun. 30, 2021.

* cited by examiner

*Primary Examiner* — Robert Karacsony

(74) *Attorney, Agent, or Firm* — Steven Stupp; Stewart Wiener

(57) ABSTRACT

An electronic device is described. This electronic device includes: an interface circuit; and an antenna having a radiator and multiple pairs of reflectors arranged along different axes passing through the radiator in a horizontal plane. A given pair of reflectors includes reflectors on opposite sides of the radiator and along a given axis. During operation, the interface circuit provides control signals to switching elements that selectively electrically couple one or more of the reflectors in the pairs of reflectors to ground, where the one or more of the reflectors modify an antenna radiation pattern of the radiator. Then, the interface circuit communicates, via the antenna, a packet or a frame with a second electronic device, where the communication involves transmitting or receiving wireless signals corresponding to the packet or the frame.

19 Claims, 9 Drawing Sheets

RECONFIGURABLE ANTENNA WITH A STRANDS ANTENNA RADIATION PATTERN

CROSS REFERENCE TO RELATED APPLICATIONS

This application claims priority under 35 U.S.C. 119(e) to: U.S. Provisional Application Ser. No. 62/994,862, "Reconfigurable Antenna with a Strands Antenna Radiation Pattern," filed on Mar. 26, 2020, by Khaled A. Obeidat et al., the contents of which are herein incorporated by reference.

FIELD

The described embodiments relate to techniques for communication. Notably, the described embodiments relate to techniques for communicating using a reconfigurable antenna with a strands antenna radiation pattern.

BACKGROUND

Many electronic devices are capable of wirelessly communicating with other electronic devices. For example, these electronic devices can include a networking subsystem that implements a network interface for a wireless local area network (WLAN), e.g., a wireless network such as described in the Institute of Electrical and Electronics Engineers (IEEE) 802.11 standard (which is sometimes referred to as 'Wi-Fi'). For example, a wireless network may include an access point that communicates wirelessly with one or more associated electronic devices (which are sometimes referred to as 'clients').

In many electronic devices, the antenna radiation patterns used to transmit or receive wireless signals are constrained by the available antennas or antenna elements. For example, in many indoor installations the antenna radiation patterns are typically monopole or dipole patterns. However, these antenna radiation patterns may not be optimal for a particular location or deployment geometry of an electronic device. Moreover, the antenna radiation patterns typically cannot address dynamic changes in the radio-frequency environment. Consequently, the antenna radiation patterns may result in wasted antenna-pattern energy and degraded communication performance.

SUMMARY

An electronic device is described. This electronic device includes: an interface circuit; and an antenna having a radiator and multiple pairs of reflectors arranged along different axes passing through the radiator in a horizontal plane. A given pair of reflectors includes reflectors on opposite sides of the radiator and along a given axis. During operation, the interface circuit provides control signals to switching elements that selectively electrically couple one or more of the reflectors in the pairs of reflectors to ground, where the one or more of the reflectors modify an antenna radiation pattern of the radiator. Then, the interface circuit communicates, via the antenna, a packet or a frame with a second electronic device, where the communication involves transmitting or receiving wireless signals corresponding to the packet or the frame.

Note that the electronic device may include an access point.

Moreover, a given reflector may be tuned to a lower frequency than the radiator. When the given reflector is selectively electrically coupled to ground, the given reflector may reflect the wireless signals in order to modify the antenna radiation pattern.

Furthermore, the antenna may include multiple pairs of directors arranged along the different axes. Note that a given pair of directors includes directors on opposite sides of the radiator along the given axis and distal to the given pair of reflectors. During operation, the interface circuit provides control signals to switching elements that selectively electrically couple one or more of the reflectors in the pairs of reflectors, one or more of the directors in the pairs of directors, or both to ground, where the one or more of the reflectors and/or the one or more of the directors modify the antenna radiation pattern of the radiator.

Additionally, a given director may be tuned to a higher frequency than the radiator. When the given director is selectively electrically decoupled to ground, the given director may re-radiate the wireless signals in order to modify the antenna radiation pattern.

In some embodiments, the antenna includes at least two pairs of reflectors and optionally at least two pairs of directors. For example, the axes of pairs of reflectors and optionally the pairs directors may be arranged North-South and East-West.

Moreover, the antenna may be disposed on a substrate (such as a printed circuit board).

In some embodiments, the modified antenna radiation pattern is more directional than the antenna radiation pattern of the radiator.

Note that the radiator may include a monopole or a dipole. Moreover, the switching elements may include a PIN diode or a radio-frequency switch.

Furthermore, the antenna may operate in two or more bands of frequencies.

Additionally, the antenna may have a predefined polarization (or orientation of the electric field), such as in a horizontal direction, in a vertical direction, in a slant direction or circular polarization. Alternatively, a transmit polarization of the wireless signals transmitted by the electronic device may be dynamically adjusted. For example, the electronic device may include a reconfigurable antenna (which is sometimes referred to as a 'polarization flexible antenna'). Notably, the antenna may include multiple antennas or antenna elements having different predefined polarizations, and the interface circuit may dynamically select the antennas or the antenna elements to adjust the transmit polarization of the wireless signals. In some embodiments, the interface circuit dynamically adjusts the transmit polarization by changing a relative phase of electrical signals corresponding to the wireless signals (e.g., using a phase-modification element, such as a tapped delay line), which are used to drive the selected antennas or antenna elements. In some embodiments, the transmit polarization is dynamically adjusted based at least in part on feedback (such as an acknowledgment, throughput, a received signal strength indicator, a signal-to-noise ratio or, more generally, a communication-performance metric) associated with the second electronic device. This dynamic adjustment may be performed on the fly and/or may be performed on a device-specific basis.

Similarly, the receive polarization of the wireless signals received by the electronic device may be dynamically adjusted.

Another embodiment provides the interface circuit.

Another embodiment provides a computer-readable storage medium with program instructions for use with the electronic device. When executed by the electronic device, the program instructions cause the electronic device to perform at least some of the aforementioned operations in one or more of the preceding embodiments.

Another embodiment provides a method, which may be performed by the electronic device. This method includes at least some of the aforementioned operations in one or more of the preceding embodiments.

This Summary is provided for purposes of illustrating some exemplary embodiments, so as to provide a basic understanding of some aspects of the subject matter described herein. Accordingly, it will be appreciated that the above-described features are examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE FIGURES

Note that like reference numerals refer to corresponding parts throughout the drawings. Moreover, multiple instances of the same part are designated by a common prefix separated from an instance number by a dash.

DETAILED DESCRIPTION

Figure 1:
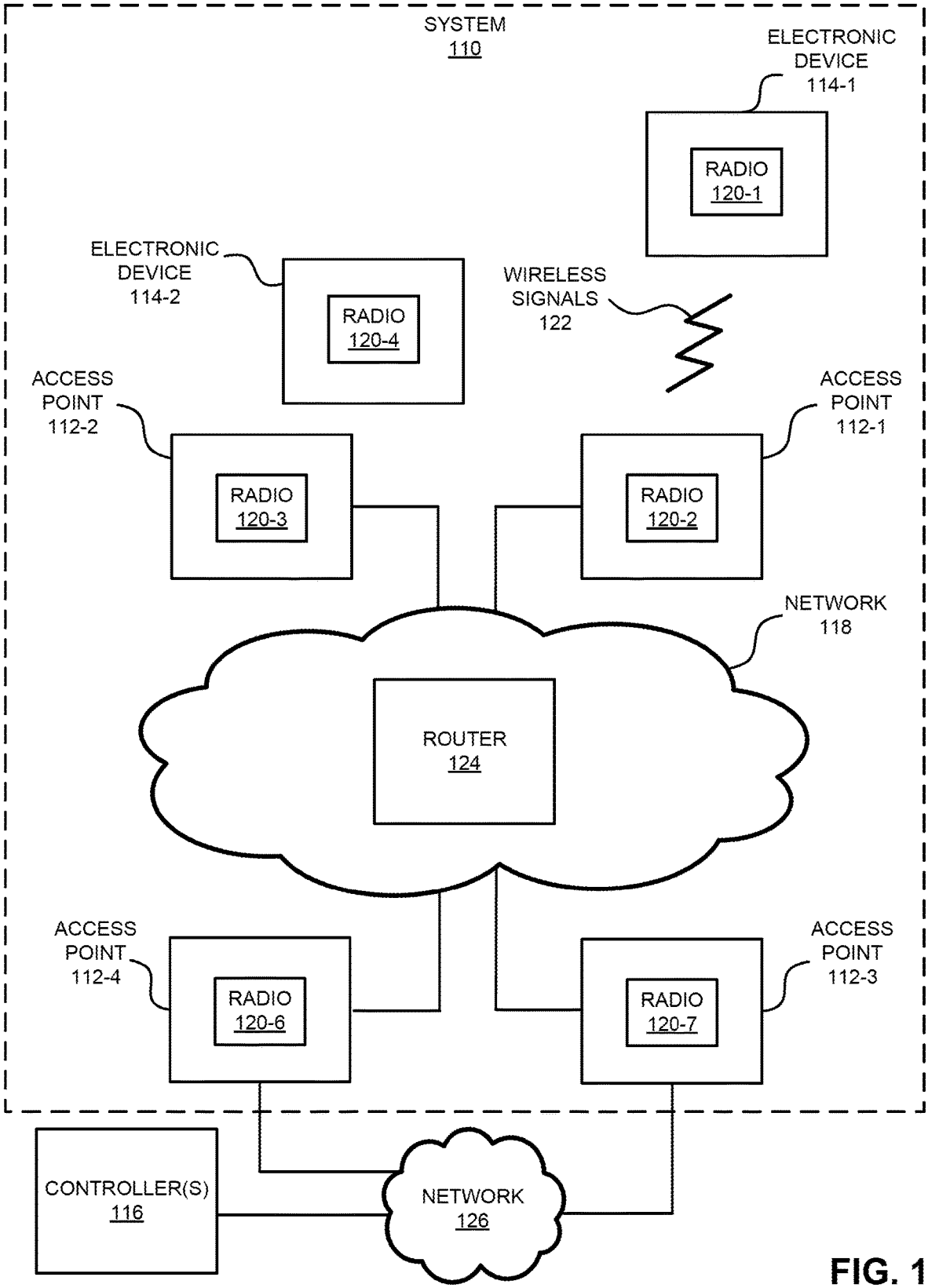
FIG. 1 is a block diagram illustrating an example of communication among electronic devices in accordance with an embodiment of the present disclosure.

An electronic device is described. This electronic device includes: an interface circuit; an antenna having a radiator; multiple pairs of reflectors arranged along different axes passing through the radiator in a horizontal plane, where a given pair of reflectors includes reflectors on opposite sides of the radiator and along a given axis; and optionally multiple pairs of directors arranged along the different axes, where a given optional pair of directors includes optional directors on opposite sides of the radiator along the given axis and distal to the given pair of reflectors. During operation, the interface circuit provides control signals to switching elements that selectively electrically couple one or more of the reflectors in the pairs of reflectors, one or more of the optional directors in the pairs of directors, or both to ground, where the one or more of the reflectors and/or the one or more of the optional directors modify an antenna radiation pattern of the radiator. Then, the interface circuit communicates, via the antenna, a packet or a frame with a second electronic device, where the communication involves transmitting or receiving wireless signals corresponding to the packet or the frame.

By modifying the antenna radiation pattern, these communication techniques may allow the electronic device to adapt the antenna to different environmental conditions. Notably, the antenna radiation pattern may be modified based at least in part on a deployment geometry, such as a location of the electronic device in an environment (such as a building) and the geometry of the surrounding environment proximate to the electronic device. For example, when the electronic device is positioned in the middle of a room, the antenna radiation pattern may be modified so that it is omnidirectional. Alternatively, when the electronic device is positioned along a wall or near a corner, the antenna radiation pattern may be modified so that it, respectively, covers half of a circle (e.g., a strands antenna radiation pattern from 0 to 180°) or one sector (i.e., from 0 to 90°). Moreover, the antenna radiation pattern may be modified based at least in part on dynamic changes in a radio-frequency environment, such as a location of the second electronic device. Thus, the additional degree of freedom provided by the antenna may allow the antenna radiation pattern to be modified or shaped in order to improve or optimize the use of the antenna-pattern energy. Consequently, the communication techniques may improve (or optimize) the communication performance (such as the throughput) with the second electronic device, and therefore may improve the user experience when using the electronic device or the second electronic device.

In the discussion that follows, electronic devices or components in a system communicate packets in accordance with a wireless communication protocol, such as: a wireless communication protocol that is compatible with an IEEE 802.11 standard (which is sometimes referred to as 'Wi-Fi®', from the Wi-Fi Alliance of Austin, Tex.), Bluetooth® (from the Bluetooth Special Interest Group of Kirkland, Wash.), and/or another type of wireless interface (such as another wireless-local-area-network interface). For example, an IEEE 802.11 standard may include one or more of: IEEE 802.11a, IEEE 802.11b, IEEE 802.11g, IEEE 802.11-2007, IEEE 802.11n, IEEE 802.11-2012, IEEE 802.11-2016, IEEE 802.11ac, IEEE 802.11ax, IEEE 802.11ba, IEEE 802.11be, or other present or future developed IEEE 802.11 technologies. Moreover, an access point in the system may communicate with a controller or services using a wired communication protocol, such as a wired communication protocol that is compatible with an Institute of Electrical and Electronics Engineers (IEEE) 802.3 standard (which is sometimes referred to as 'Ethernet'), e.g., an Ethernet II standard. However, a wide variety of communication protocols may be used in the system, including wired and/or wireless communication. In the discussion that follows, Ethernet and Wi-Fi are used as illustrative examples.

We now describe some embodiments of the communication techniques. FIG. 1 presents a block diagram illustrating an example of a system 110, which may include components, such as: one or more access points 112, one or more electronic devices 114 (such as cellular telephones, stations, another type of electronic device, etc.), and one or more optional controllers 116. In system 110, the one or more access points 112 may wirelessly communicate with the one or more electronic devices 114 using wireless communication that is compatible with an IEEE 802.11 standard. Thus, the wireless communication may occur in a 2.4 GHz, a 5 GHz, a 6 GHz and/or a 60 GHz frequency band. (Note that IEEE 802.11ad communication over a 60 GHz frequency band is sometimes referred to as 'WiGig.' In the present discussion, these embodiments also encompassed by 'Wi-Fi.') However, a wide variety of frequency bands may be used.

Moreover, wired and/or wireless communication among access points 112 in a WLAN may occur via network 118 (such as an intra-net, a mesh network, point-to-point connections and/or the Internet) and may use a network communication protocol, such as Ethernet. This network may include one or more routers and/or switches, such as router 124.

As noted previously, the one or more access points 112 and the one or more electronic devices 114 may communicate via wireless communication. Notably, one or more of access points 112 and one or more of electronic devices 114 may wirelessly communicate while: transmitting advertising frames on wireless channels, detecting one another by scanning wireless channels, exchanging subsequent data/management frames (such as association requests and responses) to establish a connection, configure security options (e.g., Internet Protocol Security), transmit and receive frames or packets via the connection (which may include the association requests and/or additional information as payloads), etc.

In some embodiments, the wired and/or wireless communication among access points 112 also involves the use of dedicated connections, such as via a peer-to-peer (P2P) communication technique. Therefore, access points 112 may support wired communication within the WLAN (such as Ethernet) and wireless communication within the WLAN (such as Wi-Fi), and one or more of access points 112 may also support a wired communication protocol (such as Ethernet) for communicating via network 126 (such as the Internet) with other electronic devices, such as a computer or the one or more optional controllers 116 of the WLAN. Note that the one or more optional controllers 116 may be at the same location as the other components in system 110 or may be located remotely (i.e., at a different location). Moreover, note that the one or more access points 112 may be managed by the one or more optional controllers 116. Furthermore, note that the one or more access points 112 may be a physical access point or a virtual or 'software' access point that is implemented on a computer or an electronic device.

Figure 9:
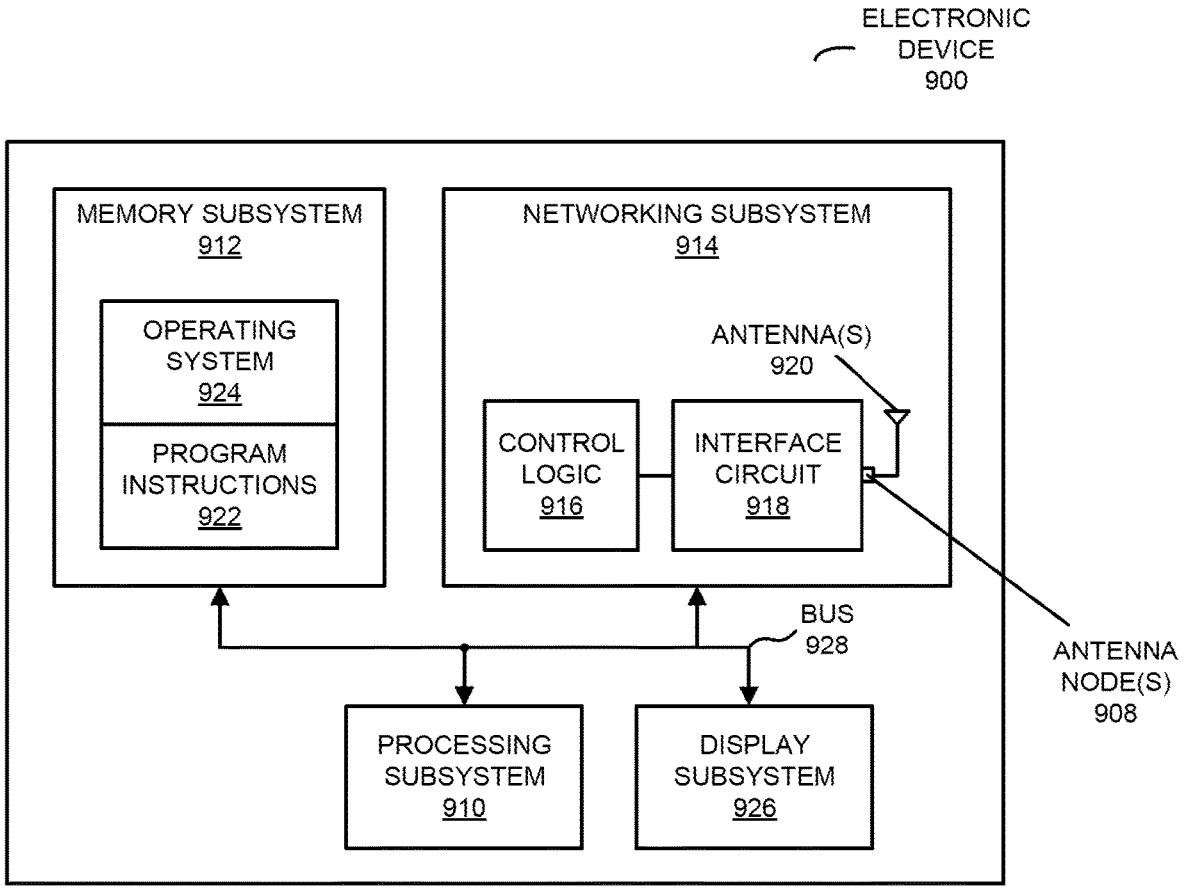
FIG. 9 is a block diagram illustrating an example of an electronic device in accordance with an embodiment of the present disclosure.

As described further below with reference to FIG. 9, the one or more access points 112, the one or more electronic devices 114 and/or the one or more optional controllers 116 may include subsystems, such as a networking subsystem, a memory subsystem and a processor subsystem. In addition, the one or more access points 112 and the one or more electronic devices 114 may include radios 120 in the networking subsystems. More generally, the one or more access points 112 and the one or more electronic devices 114 can include (or can be included within) any electronic devices with the networking subsystems that enable the one or more access points 112 and the one or more electronic devices 114 to wirelessly communicate with each other.

As can be seen in FIG. 1, wireless signals 122 (represented by a jagged line) are transmitted from a radio 120-2 in at least one of the one or more access points 112, such as access point 112-1. These wireless signals are received by radio 120-1 in electronic device 114-1. In particular, access point 112-1 may transmit frames or packets. In turn, these frames or packets may be received by electronic device 114-1. This may allow access point 112-1 to communicate information to electronic device 114-1. Note that the communication between electronic device 114-1 and access point 112-1 may be characterized by a variety of performance metrics, such as: a data rate, a data rate for successful communication (which is sometimes referred to as a 'throughput'), an error rate (such as a retry or resend rate), a mean-square error of equalized signals relative to an equalization target, intersymbol interference, multipath interference, a signal-to-noise ratio, a width of an eye pattern, a ratio of number of bytes successfully communicated during a time interval (such as 1-10 s) to an estimated maximum number of bytes that can be communicated in the time interval (the latter of which is sometimes referred to as the 'capacity' of a communication channel or link), and/or a ratio of an actual data rate to an estimated data rate (which is sometimes referred to as 'utilization'). While instances of radios 120 are shown in the one or more electronic devices 114 and the one or more access points 112, one or more of these instances may be different from the other instances of radios 120.

As noted previously, the antenna radiation patterns used to transmit or receive wireless signals are often constrained by the available antennas or antenna elements. However, these antenna radiation patterns may not be well suited for a particular location or environment where an electronic device is deployed. This can result in wasted antenna-pattern energy and degraded communication performance.

In order to address this challenge, the one or more access points 112 (such as access point 112-1) may implement or use the communication techniques. Notably, as discussed further below with reference to FIGS. 2-8, during the communication techniques access point 112-1 may communicate a packet or a frame (e.g., to electronic device 114-1) using wireless signals. The wireless signals may be transmitted by an instance of an antenna in access point 112-1 that has an antenna radiation pattern. Alternatively, access point 112-1 may receive, using the same or another instance of the antenna, wireless signals corresponding to a packet or a frame (e.g., from electronic device 114-1). Note that in some embodiments, access point 112-1 may communicate the packet or the frame using MIMO. For example, access point 112-1 may use 2×2, 4×4, 8×8, 16×16 or N×N (where N is an integer) MIMO.

Figure 4:
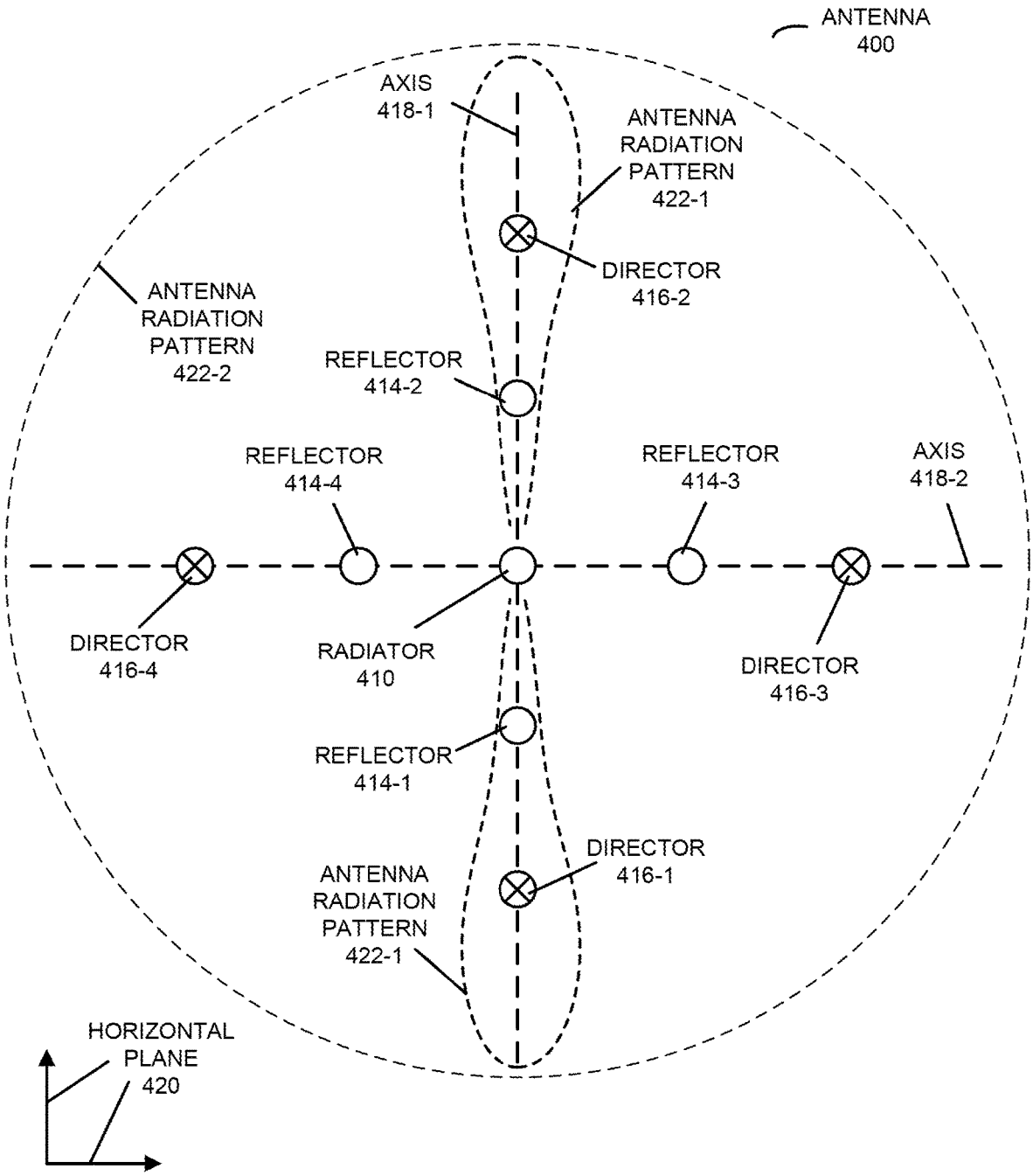
FIG. 4 is a drawing illustrating an example of an antenna having a dynamically adjustable antenna radiation pattern in accordance with an embodiment of the present disclosure.

The antenna radiation pattern may be dynamically adjusted or modified. For example, the antenna radiation pattern may be selectively directed into one or more sectors in a horizontal plane (e.g., in a stands antenna radiation pattern along 0 and 180° or 90 and 270°. In some embodiments, the instance of the antenna may have a reconfigurable antenna radiation pattern that provides up to 6 dB of gain with coverage over 360°. Notably, as shown in FIG. 4, an antenna 400 (or an instance of an antenna) may include: a radiator 410 (such as a monopole or a dipole) and multiple pairs of reflectors 414 and optional pairs of directors 416 arranged along different axes 418 passing through radiator 410 in a horizontal (azimuth) plane 420 (which may be parallel to a floor in the environment). A given pair of reflectors may include reflectors on opposite sides of radiator 410 and along a given axis. Moreover, an optional given pair of directors may include optional directors on opposite sides of radiator 410 along the given axis and distal to the given pair of reflectors.

Note that optional directors 416 may be tuned to resonate at a higher frequency than radiator 410 and reflectors 414 may be tuned to resonate at a lower frequency than radiator 410. For example, a given reflector may be implemented using metal disposed behind a monopole or a dipole. The given reflector may have a length that is, e.g., 1.1-1.15× a length of radiator 410. Moreover, the given optional director may have a length that is, e.g., 0.9-0.95× the length of radiator 410. Consequently, the given reflector and/or the given optional director may be tuned to resonate at a frequency that is offset by 0.18-0.25× a carrier or resonant frequency of radiator 410.

Radio 120-2 (FIG. 1) may selectively electrically couple (or decouple) one or more of reflectors 414 and/or one or more of optional directors 416 to ground to dynamically adjust or modify antenna radiation pattern such as antenna radiation pattern 422-1 or 422-2. For example, radio 120-2 (FIG. 1) may provide control signals to switching elements associated with reflectors 414 and/or optional directors 416 (such as a PIN diode, a GaAs FET, a MEMS switch or a radio-frequency switch). When the given reflector is selectively electrically coupled to ground or a ground plane (e.g., by forward biasing a PIN diode), the given reflector may reflect the wireless signals in order to modify the antenna radiation pattern (e.g., by making the antenna radiation pattern more directional (in an opposite direction from the given reflector) than an unmodified antenna radiation pattern of radiator 410). Alternatively, when the PIN diode is reversed biased, the given reflector may be decoupled from ground (or the ground plane) and may not modify the antenna radiation pattern of the given antenna appreciably. In the present discussion, note that electrical coupling to ground may include a DC electrical connection.

Furthermore, when the given optional director is selectively electrically decoupled from ground or a ground plane (e.g., by reverse biasing a PIN diode), the given optional director may re-radiate the wireless signals in order to modify the antenna radiation pattern (e.g., by making the antenna radiation pattern more directional (in the direction of the given optional director) than an unmodified antenna radiation pattern of radiator 410). For example, an optional director may provide 1-2 dB of gain for the antenna. Alternatively, when the PIN diode is forward biased, the given optional director may be selectively electrically coupled to ground or a ground plane, and may not modify the antenna radiation pattern of the given antenna appreciably.

In some embodiments, antenna 400 includes at least two pairs of reflectors 414 and at least two optional pairs of directors 416 (such as a pair including reflectors 414-3 and 414-4 and an optional pair including optional directors 416-3 and 416-4). Note that axes 418 of the pairs of reflectors 414 and the pairs of operation directors 416 may be at right angles to each other. For example, axes 418 may be arranged North-South and East-West in horizontal plane 420.

Moreover, antenna 400 may operate in one or more bands of frequencies, such as a dual-band antenna. For example, antenna 400 may operate in a 2.4 GHz band of frequencies and a 5 GHz band of frequencies. In some embodiments, antenna 400 may be configured for dual band operation.

Furthermore, antenna 400 may be disposed on a substrate (such as a printed circuit board). Furthermore, access point 112-1 may include one or more additional antennas. A given additional antenna may be disposed on another substrate. This other substrate may have a different orientation than the substrate. For example, access point 112-1 may include an antenna (or an instance of an antenna) having a vertical polarization, and another antenna (or an instance of another antenna) having a horizontal polarization. In some embodiments, access point 112-1 (FIG. 1) may include an antenna selector (such as a radio-frequency switch, e.g., a single-pole, double-throw switch) that selectively electrically couples radio 120-2 (FIG. 1) or an associated radio-frequency feed port to one or more of the antennas (or the instances of the antenna).

Additionally, reflectors 414 and/or optional directors 416 may be used to control an antenna gain of the antenna (such as in increments of 1 dB, e.g., 1 dB, 2 dB or 3 dB).

While FIG. 4 is illustrated with pairs of reflectors 414 and optional pairs of directors 416 along axes 418, in some embodiments antenna 400 may include additional pairs of reflectors 414 and additional optional pairs of directors 416 along additional axes (not shown), such as axes at different angles in horizontal plane 420 relative to axes 418 (such as additional axes at ±45°). These additional pairs of reflectors 414 and additional optional pairs of directors 416 may allow finer granularity angular adjustments to antenna radiation pattern 420. Alternatively or additionally, the additional pairs of reflectors 414 and additional optional pairs of directors 416 may be tuned for a second band of frequencies (such as reflectors and optional directors that are appropriately tuned above and below the frequency of a radiator for the second band of frequencies).

Referring back to FIG. 1, in some embodiments the antenna radiation pattern is modified based at least in part on a deployment geometry or an environment of access point 112-1. Thus, different antenna radiation patterns may be selected when access point 112-1 is in the middle of a room, along a wall, in a corner, or mounted on the ceiling. Alternatively, the antenna radiation pattern may be modified based at least in part on feedback received from electronic device 114-1. For example, electronic device 114-1 may determine one or more communication-performance metrics (such as throughput, a received signal strength indicator, a signal-to-noise ratio or another communication-performance metric) associated with the packet or the frame received from access point 112-1. Then, electronic device 114-1 may provide the feedback (such as an acknowledgment) corresponding to or that includes the one or more communication-performance metrics (such as information specifying the one or more communication-performance metrics) to access point 112-1. Note that the modification of the antenna radiation pattern may be performed on the fly (such as when the packet or the frame is communicated) and/or may be performed on a device-specific basis (such as for electronic device 114-1)

Moreover, radiator 410 (FIG. 1) may have a predefined polarization (or orientation of the electric field), such as in a horizontal direction, in a vertical direction, in a slant direction or circular polarization. However, in some embodiments, the transmit and/or receive polarization of the wireless signals may be dynamically adjusted. For example, access point 112-1 may include a reconfigurable antenna (which is sometimes referred to as a 'polarization flexible antenna'). Notably, the antenna may include multiple antennas or antenna elements having different predefined polarizations, and radio 120-2 may dynamically select or use one or more of these antennas or the antenna elements to adjust the transmit and/or receive polarization of the wireless signals. In some embodiments, radio 120-2 dynamically adjusts the transmit or receive polarization by changing a relative magnitude and/or phase of electrical signals corresponding to the wireless signals (e.g., using a filter and/or a phase-modification element, such as a tapped delay line, between radio 120-2 and the antennas and/or antenna elements), which, for transmission, are used to drive the selected antennas or antenna elements, or which, for reception, are received by antennas or antenna elements.

In some embodiments, the transmit and/or receive polarization is dynamically adjusted based at least in part on feedback (such as an acknowledgment, information specifying a throughput, information specifying a received signal strength indicator, information specifying a signal-to-noise ratio or, more generally, a communication-performance metric) associated with electronic device 114-1. Note that the dynamic adjustment may be performed on the fly (such as when the packet or the frame is communicated) and/or may be performed on a device-specific basis (such as for electronic device 114-1). Consequently, access point 112-1 may use an arbitrary polarization (linear, e.g., horizontal, vertical or any slant, circular or elliptical) to transmit and/or receive the packet or the frame.

In this way, the communication techniques may allow different antenna radiation patterns to be obtained even with a set of one or more available radiators. Moreover, the communication techniques may allow the antenna radiation pattern of access point 112-1 to be customized to a particular environment or deployment geometry and/or based at least in part on a dynamic communication environment. Consequently, the communication techniques may improve (or optimize) the communication performance (such as the throughput) with electronic device 114-1, and therefore may improve the user experience in system 110.

In the described embodiments, processing a frame or a packet in the electronic devices and/or the one or more access points may include: receiving wireless signals 122 with the frame or packet; decoding/extracting the frame or packet from the received wireless signals 122 to acquire the frame or packet; and processing the frame or packet to determine information contained in the frame or packet.

Although we describe the network environment shown in FIG. 1 as an example, in alternative embodiments, different numbers or types of electronic devices or components may be present. For example, some embodiments comprise more or fewer electronic devices or components. Therefore, in some embodiments there may be fewer or additional instances of at least some of the one or more access points 112, the one or more electronic devices 114, and/or the one or more optional controllers 116. As another example, in another embodiment, different electronic devices are transmitting and/or receiving frames or packets.

Figure 2:
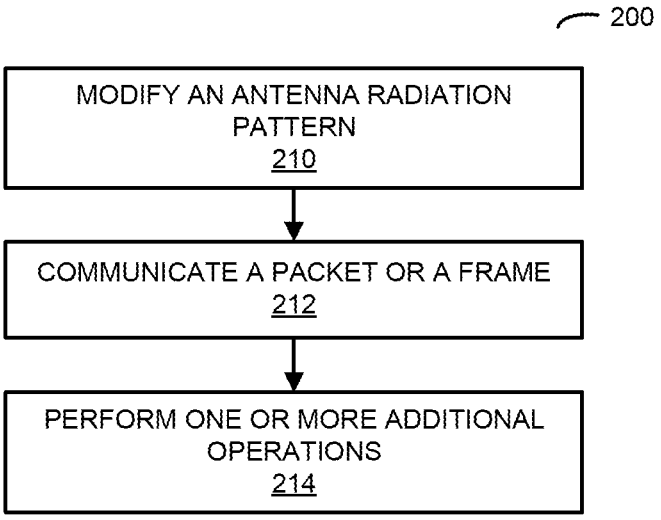
FIG. 2 is a flow diagram illustrating an example of a method for communicating a packet or a frame in accordance with an embodiment of the present disclosure.

We now describe embodiments of the method. FIG. 2 presents a flow diagram illustrating an example of a method 200 for communicating a packet or a frame. Moreover, method 200 may be performed by an electronic device, such as one of the one or more access points 112 in FIG. 1, e.g., access point 112-1. During operation, the electronic device may modify an antenna radiation pattern (operation 210) of an antenna, where the antenna includes: a radiator; multiple pairs of reflectors arranged along different axes passing through the radiator in a horizontal plane, where a given pair of reflectors includes reflectors on opposite sides of the radiator and along a given axis; and optionally multiple pairs of directors arranged along the different axes, where a given optional pair of directors includes optional directors on opposite sides of the radiator along the given axis and distal to the given pair of reflectors. Moreover, modifying the antenna radiation pattern includes selectively electrically coupling one or more of the reflectors, one or more of the optional directors, or both to ground. For example, the electronic device may provide control signals to switching elements that selectively electrically couple the one or more of the reflectors, one or more of the optional directors, or both to ground.

Then, the electronic device may communicate, via the antenna, the packet or the frame (operation 212) with a second electronic device, where the communication includes transmitting or receiving wireless signals corresponding to the packet or the frame.

In some embodiments, the electronic device optionally performs one or more additional operations (operation 214). For example, the electronic device may dynamically adjust a polarization of the wireless signals. Moreover, the electronic device may receive feedback associated with the second electronic device, and the modification of the antenna radiation pattern and/or the dynamic adjustment of the polarization may be based at least in part on the feedback.

In some embodiments of method 200, there may be additional or fewer operations. Moreover, the order of the operations may be changed, and/or two or more operations may be combined into a single operation.

Figure 3:
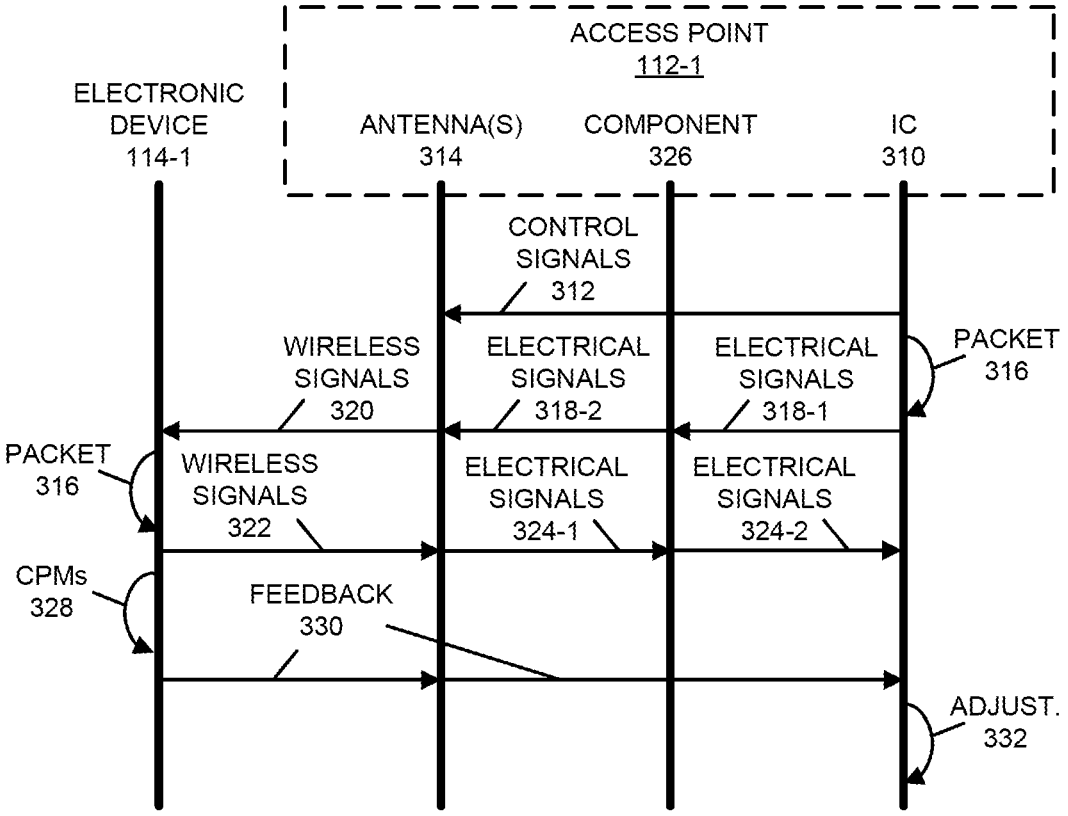
FIG. 3 is a drawing illustrating an example of communication among components in an electronic device in FIG. 1 in accordance with an embodiment of the present disclosure.

Embodiments of the communication techniques are further illustrated in FIG. 3, which presents a drawing illustrating an example of communication between access point 112-1 and electronic device 114-1 according to some embodiments. Notably, interface circuit (IC) 310 in access point 112-1 may provide control signals 312 to one or more antennas 314. These controls signals may dynamically modify one or more antenna radiation patterns of the one or more antennas 314. For example, a given antenna in the one or more antennas 314 may include: a radiator; multiple pairs of reflectors arranged along different axes passing through the radiator in a horizontal plane, where a given pair of reflectors includes reflectors on opposite sides of the radiator and along a given axis; and optionally multiple pairs of directors arranged along the different axes, where a given optional pair of directors includes optional directors on opposite sides of the radiator along the given axis and distal to the given pair of reflectors. Control signals 312 may modifying the antenna radiation pattern(s) by changing states of one or more switching elements (such as by forward biasing a PIN diode) that selectively electrically coupling one or more of the reflectors, one or more of the optional directors, or both to ground.

Then, interface circuit 310 may communicate, via the one or more antennas 314, a packet 316 or a frame with electronic device 114-1. For example, interface circuit 310 may provide electrical signals 318 corresponding to packet 316 to a given one of the one or more antennas 314, which may transmit wireless signals 320 corresponding to packet 316 to electronic device 114-1. Alternatively, electronic device 114-1 may transmit wireless signals 322 corresponding to packet 316 to access point 112-1, which may receive wireless signals 322 using a given one of the one or more antennas 314, and may provide electrical signals 324 to interface circuit 310.

In some embodiments, interface circuit 310 may dynamically adjust or change a polarization of wireless signals 320 or 322. For example, interface circuit 310 may discontinue transmitting using one of the one or more antennas 314 that has a first predefined polarization (such as a horizontal polarization) and may transmit using another one of antennas 314 that has a second predefined polarization (such as a vertical polarization), or interface circuit 310 may transmit wireless signals 320 using two or more of antennas 314. Furthermore, interface circuit 310 may change a relative magnitude and/or a relative phase of electrical signals 318 that drive one or more of antennas 314, e.g., by providing one or more control signals to a component 326 (such as a filter and/or a phase-modification element) between interface circuit 310 and antennas 314.

Note that the dynamic adjustment of the antenna radiation pattern and/or the polarization may be based at least in part on feedback 330 from electronic device 114-1. Notably, after receiving wireless signals 320, electronic device 114-1 may determine one or more communication-performance metrics (CPMs) 328 and then may provide feedback 330 to access point 112-1. This feedback may include an acknowledgment and/or information that specifies the one or more communication-performance metrics (such as a received signal strength, a throughput, etc.). After receiving feedback 330, interface circuit 310 may determine an adjustment 332 to one or more of the antenna radiation patterns and/or the polarization.

While not shown in FIG. 3, access point 112-1 may dynamically modify one or more of antenna radiation patterns and/or the polarization of the wireless signals 322. Note that these modifications or adjustments may be based at least in part on one or more communication-performance metrics associated with the communication of packet 316 from electronic device 114-1, such as one or more communication-performance metrics determined by interface circuit 310.

Moreover, while FIG. 3 illustrates communication between components using unidirectional or bidirectional communication with lines having single arrows or double arrows, in general the communication in a given operation in this figure may involve unidirectional or bidirectional communication.

In some embodiments of the communication techniques, an access point may use the capabilities illustrated in FIG. 4 to dynamically adjust an antenna radiation pattern and/or an antenna gain. These capabilities may allow the creation of antenna-radiation patterns that are more suited to the deployed environment or that adapt to a dynamic wireless environment (such as the current location of a client). This may cause the antenna-pattern energy to be more directive in a sector in the horizontal plane. For example, it may be desirable to direct the antenna radiation pattern differently for a corner in a room versus the center of the room. More generally, the antenna radiation pattern may be dynamically changed between an omnidirectional antenna radiation pattern and a directional antenna radiation pattern (which has gain in a particular direction(s) relative to the omnidirectional radiation pattern, e.g., a cardioid directional radiation pattern).

Figure 5:
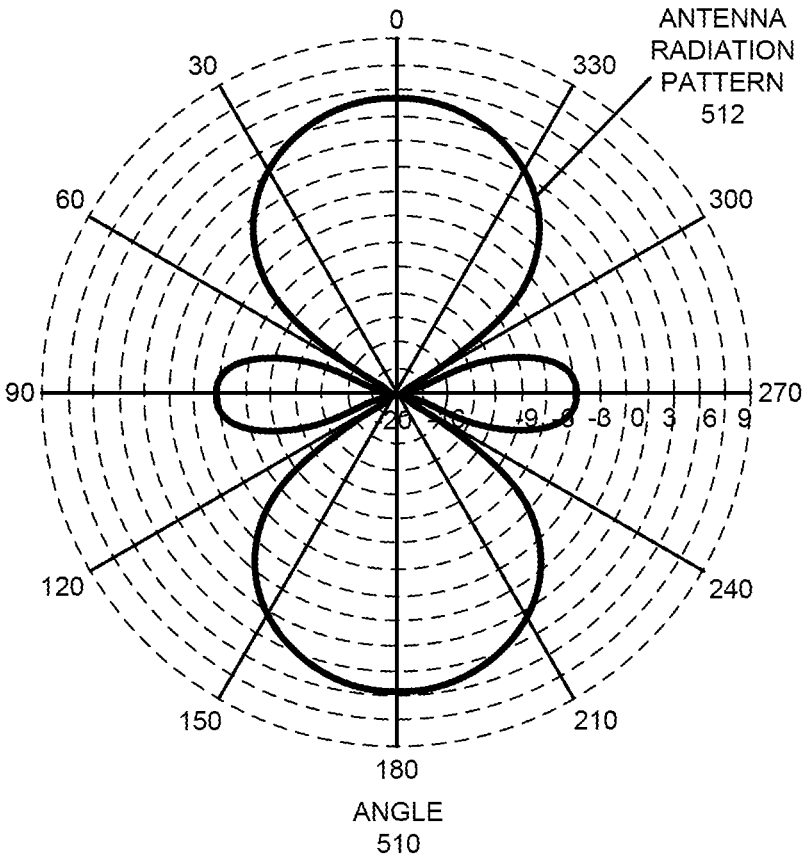
FIG. 5 is a drawing illustrating an example of antenna gain as a function of angle in a horizontal plane in accordance with an embodiment of the present disclosure.

FIG. 5 presents a drawing illustrating an example of antenna gain in dBi (as indicated by the dashed circles) as a function of angle 510 in a horizontal plane according to some embodiments. In FIG. 5, antenna radiation pattern 512 is shown when switching elements (or PIN diodes) for a pair of reflectors 414-3 and 414-4 (FIG. 4) along axis 418-2 in antenna 400 (FIG. 4) are turned on or electrically coupled to ground or a ground plane, and/or optional pair of directors 416-1 and 416-2 in antenna 400 (FIG. 4) along axis 418-1 are turned off or electrically decoupled from ground or the ground plane. The resulting antenna gain is approximately 6 dB (while an omnidirectional antenna radiation pattern may have an antenna gain of 3 dB).

In FIG. 5, note that, e.g., the frequency of radiator 410 (FIG. 4) may be 3.6 GHz, the antenna-radiation-pattern main lobe magnitude may be 2.85 dBi, the antenna-radiation-pattern main lobe direction may be 153°, the antenna-radiation-pattern angular width (3 dB) may be 132.7°, and the antenna-radiation-pattern side lobe level may be −1.6 dB.

Figure 6:
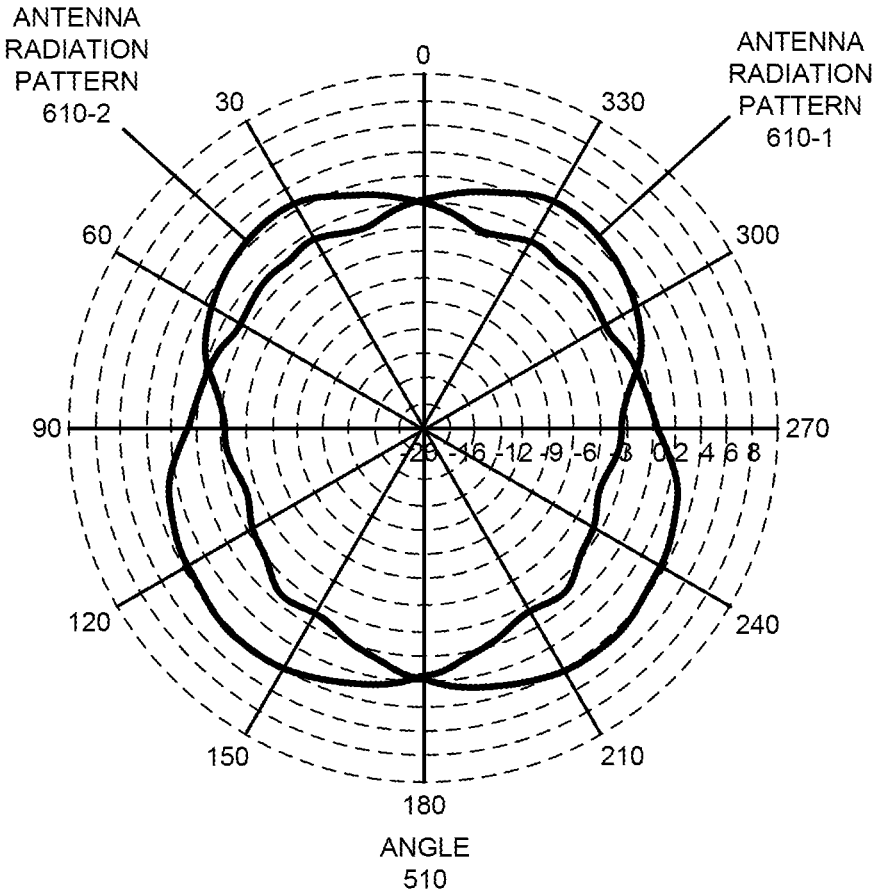
FIG. 6 is a drawing illustrating an example of antenna gain as a function of angle in a horizontal plane in accordance with an embodiment of the present disclosure.

Alternatively, as shown in FIG. 6, which presents a drawing illustrating an example of antenna gain in dBi (as indicated by the dashed circles) as a function of angle 510 in a horizontal plane according to some embodiments, antenna radiation patterns 610 may be obtained when reflectors 414 (FIG. 4) on one side of one of axes 418 in antenna 400 (FIG. 4) are turned on or electrically coupled to ground or a ground plane, and/or optional directors 416 in antenna 400 (FIG. 4) along this side of the one of axes 418 are turned off or electrically decoupled from ground or the ground plane. For example, reflectors 414-2 and 414-3 (FIG. 4) may be electrically coupled to ground or the ground plane, and optional directors 416-2 and 416-3 (FIG. 4) may be electrically decoupled from ground or the ground plane. Note that antenna radiation patterns 610 may be stranded antenna radiation patterns orientated approximately at ±45° in horizontal plane 420 (FIG. 4).

Figure 7:
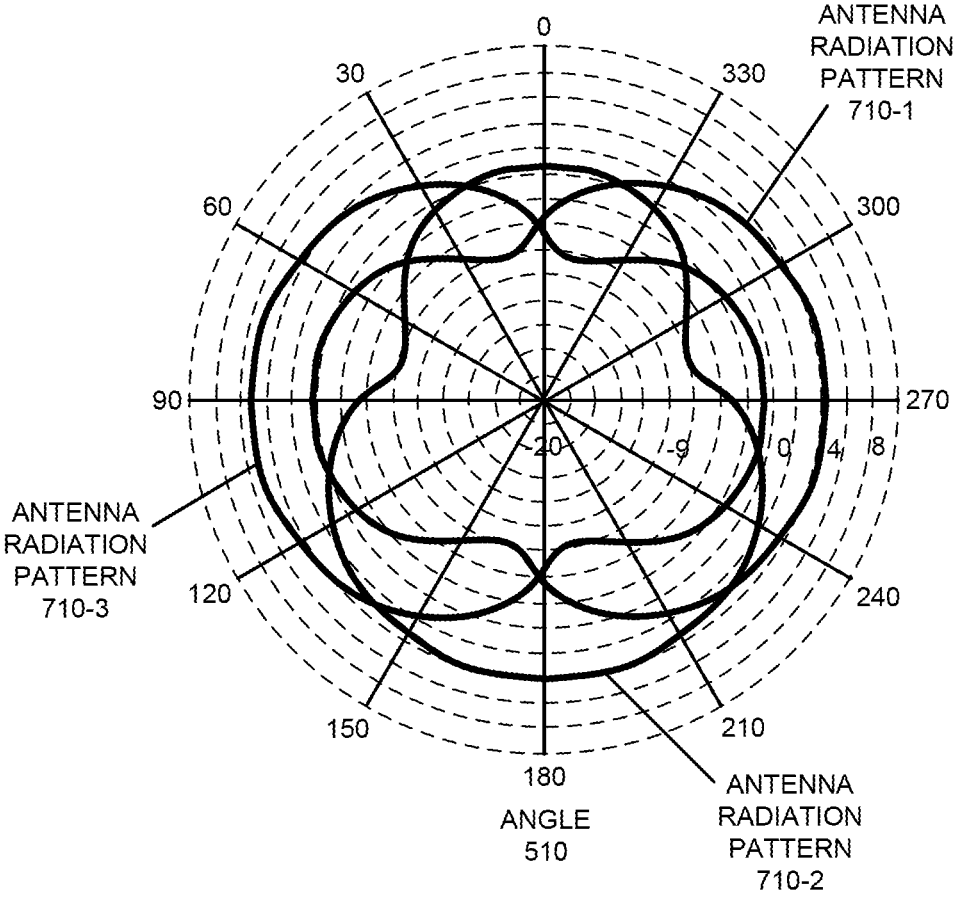
FIG. 7 is a drawing illustrating an example of antenna gain as a function of angle in a horizontal plane in accordance with an embodiment of the present disclosure.

FIG. 7 presents a drawing illustrating an example of antenna gain in dBi (as indicated by the dashed circles) as a function of angle 510 in a horizontal plane according to some embodiments. In FIG. 7, antenna radiation patterns 710 may be obtained by turning on or selectively electrically coupling a subset of reflectors 414 (FIG. 4) along axes 418 (FIG. 4) ground or a ground plane, and/or by turning off or selectively electrically decoupling a subset of optional directors 416 in antenna 400 (FIG. 4) along axes 418 (FIG. 4). For example, antenna radiation pattern 710-1 may be obtained by selectively electrically coupling reflector 414-3 and directors 416-1, 416-2 and 416-3 to ground, while selectively electrically decoupling director 416-4 and reflectors 414-1, 414-2 and 414-4 from ground. Note that antenna radiation patterns 710 may have sector antenna radiation patterns.

In some embodiments, the antenna may have an adjustable of modifiable antenna radiation pattern, including an omnidirectional antenna radiation pattern, and two different strands or stranded antenna radiation patterns rotated by 90° from each other by selectively electrically turning on or off one or more switching elements or PIN diodes. In some embodiment, the antenna includes four reflectors along two different axes. In order to obtain the omnidirectional antenna radiation pattern, all of the reflectors may be turned on or selectively electrically coupled to ground or a ground plane. Alternatively, to obtain one of the strands or stranded antenna radiation patterns a pair of reflectors along one of the axes may be turned on or selectively electrically coupled to ground or the ground plane, while the other pair of reflectors along the other of the axes may be turned off or selectively electrically decoupled from ground or the ground plane. In addition, other antenna radiation patterns may be obtained by turning on or selectively electrically coupling to ground or the ground plane other groups of reflectors. Note that an antenna gain of the antenna may be 6 dB. However, additional antenna gain may be obtained by adding the four optional directors.

Figure 8:
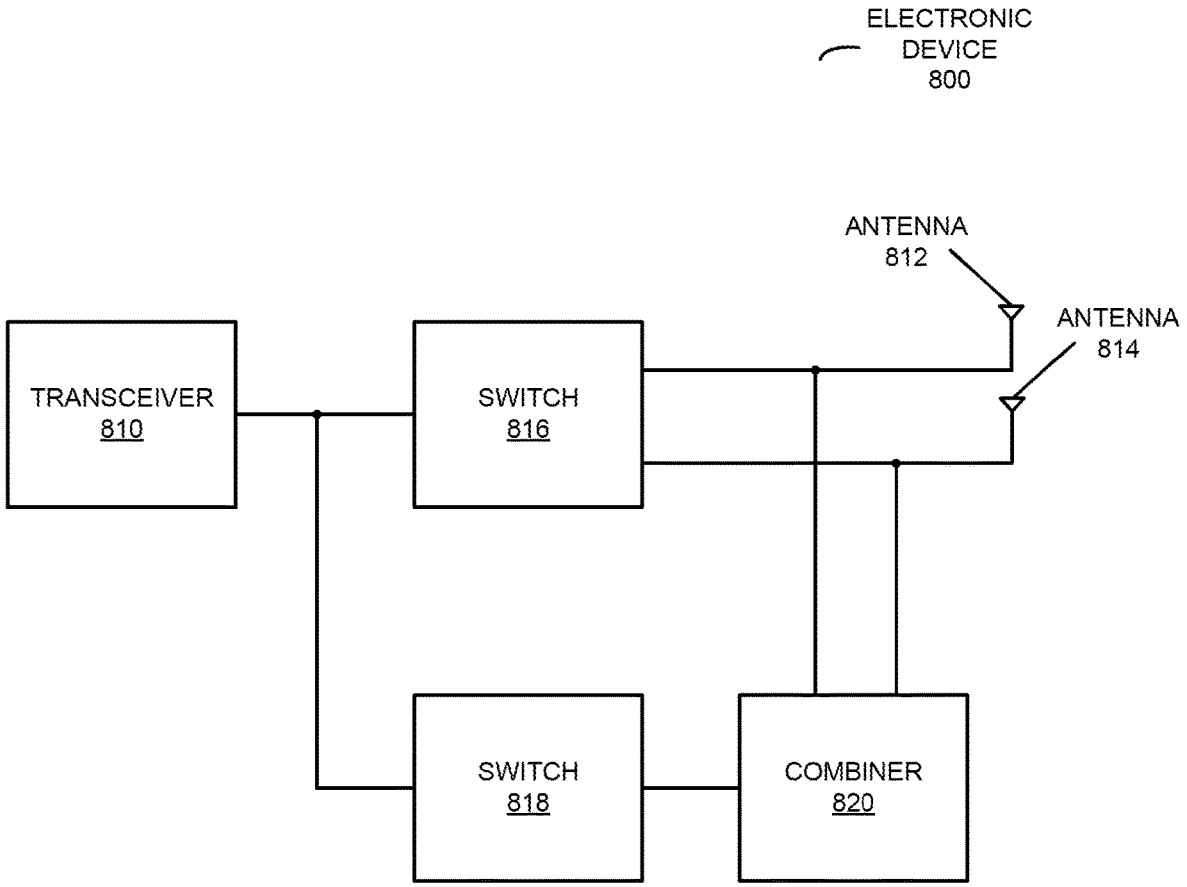
FIG. 8 is a drawing illustrating an example of an electronic device having an adjustable polarization in accordance with an embodiment of the present disclosure.

FIG. 8 presents a drawing illustrating an example of an electronic device having an adjustable polarization in accordance with an embodiment of the present disclosure. Notably, electronic device 800 may include a transceiver 810, and antennas 812 and 814. Alternatively, in some embodiments, antennas 812 and 814 may be antenna elements in an antenna. During operation, transceiver 810 may selectively provide electrical signals to antennas 812 and/or 814 via switch 816 or switch 818 and combiner 820. In some embodiments, switch 816 may selectively provide electrical signals to either antenna 812 or 814. Alternatively, switch 818 and combiner 820 may selectively provide electrical signals to both of antennas 812 and 814. Moreover, transceiver 810 may provide control signals to a phase-modification element 822 and/or a filter 814, thereby changing a relative magnitude and/or relative phase of electrical signals to antennas 812 and 814. In these ways, the selected antennas 812 and/or 814 may transmit wireless signals having an arbitrary net polarization.

While FIG. 8 illustrates transmission, a similar configuration may be used during receiving. In some embodiments, a pair of antennas having predefined polarizations may be used for transmitting and for receiving. For example, the pair of antennas may be time multiplexed for transmitting and for receiving.

Note that dynamically changing or adjusting the polarization may not increase the gain of the antenna radiation pattern. Instead, the dynamically changed or adjusted polarization may reduce or eliminate the effect of a fading null at one polarization and/or a change in the polarization because of reflections.

Moreover, note that the preceding embodiments may include fewer or additional components, two or more components may be combined into a single component, and/or positions of one or more components may be changed.

In some embodiments, a given antenna may be or may include a monopole or a dipole (such as a bent dipole antenna) or a slot antenna. For example, a dipole antenna may have a horizontal polarization and a slot antenna may have a vertical polarization. However, a wide variety of types of antennas and/or antenna elements may be used. The antennas may be free-standing and/or may be implemented on a substrate or a printed-circuit board (e.g., FR4, Rogers 4003, or another dielectric material), such as by using metal or another radio-frequency conducting foil on one side of the substrate and a ground plane on the other (coplanar) side of the substrate. Moreover, one or more additional components may be optionally included on either or both sides of the substrate. Note that the given antenna may have a polarization substantially in a plane of the substrate.

Moreover, the dimensions of the individual components in the given antenna may be established by use of radio-frequency simulation software, such as IE3D from Zeland Software of Fremont, Calif. In some embodiments, the given antenna may include one or more additional components, such as passive components that implement phase or impedance matching, that change a resonance frequency, that broaden the frequency response (or bandwidth), etc. For example, in the 2.4 to 2.4835 GHz band of frequencies, the frequency response of a dipole may be between 300-500 MHz.

Furthermore, switching at radio frequency (as opposed to baseband) may allow the access point to have fewer up/down converters and may simplify impedance matching between the interface circuit and the antennas. For example, a given antenna may provide an impedance match under all configurations of selected antenna elements, regardless of which antenna elements are selected. In some embodiments, a match with less than 10 dB return loss may be maintained under all configurations of selected antenna elements, over the range of frequencies (such as a band of frequencies in an IEEE 802.11 standard), regardless of which antenna elements are selected.

Alternatively or additionally to using antenna elements to vary the antenna radiation pattern, in some embodiments the communication techniques may be used in conjunction with beamforming. Note that the changes in the antenna radiation pattern and/or the beamforming may be used during transmission and/or receiving.

We now describe embodiments of an electronic device, which may perform at least some of the operations in the communication techniques. For example, the electronic device may include a component in system 110, such as one of: the one or more access points 112, the one or more electronic devices 114 and/or the one or more optional controllers 116. FIG. 9 presents a block diagram illustrating an electronic device 900 in accordance with some embodiments. This electronic device includes processing subsystem 910, memory subsystem 912, and networking subsystem 914. Processing subsystem 910 includes one or more devices configured to perform computational operations. For example, processing subsystem 910 can include one or more microprocessors, ASICs, microcontrollers, programmable-logic devices, graphical processor units (GPUs) and/or one or more digital signal processors (DSPs).

Memory subsystem 912 includes one or more devices for storing data and/or instructions for processing subsystem 910 and networking subsystem 914. For example, memory subsystem 912 can include dynamic random access memory (DRAM), static random access memory (SRAM), and/or other types of memory (which collectively or individually are sometimes referred to as a 'computer-readable storage medium'). In some embodiments, instructions for processing subsystem 910 in memory subsystem 912 include: one or more program modules or sets of instructions (such as program instructions 922 or operating system 924), which may be executed by processing subsystem 910. Note that the one or more computer programs may constitute a computer-program mechanism. Moreover, instructions in the various program instructions in memory subsystem 912 may be implemented in: a high-level procedural language, an object-oriented programming language, and/or in an assembly or machine language. Furthermore, the programming language may be compiled or interpreted, e.g., configurable or configured (which may be used interchangeably in this discussion), to be executed by processing subsystem 910.

In addition, memory subsystem 912 can include mechanisms for controlling access to the memory. In some embodiments, memory subsystem 912 includes a memory hierarchy that comprises one or more caches coupled to a memory in electronic device 900. In some of these embodiments, one or more of the caches is located in processing subsystem 910.

In some embodiments, memory subsystem 912 is coupled to one or more high-capacity mass-storage devices (not shown). For example, memory subsystem 912 can be coupled to a magnetic or optical drive, a solid-state drive, or another type of mass-storage device. In these embodiments, memory subsystem 912 can be used by electronic device 900 as fast-access storage for often-used data, while the mass-storage device is used to store less frequently used data.

Networking subsystem 914 includes one or more devices configured to couple to and communicate on a wired and/or wireless network (i.e., to perform network operations), including: control logic 916, an interface circuit 918 and one or more antennas 920 (or antenna elements). (While FIG. 9 includes one or more antennas 920, in some embodiments electronic device 900 includes one or more nodes, such as nodes 908, e.g., a pad, which can be coupled to the one or more antennas 920. Thus, electronic device 900 may or may not include the one or more antennas 920.) For example, networking subsystem 914 can include a Bluetooth networking system, a cellular networking system (e.g., a 3G/4G/5G network such as UMTS, LTE, etc.), a USB networking system, a networking system based on the standards described in IEEE 802.11 (e.g., a Wi-Fi networking system), an Ethernet networking system, and/or another networking system.

In some embodiments, a transmit antenna radiation pattern of electronic device 900 may be adapted or changed using pattern shapers (such as reflectors) in one or more antennas 920 (or antenna elements), which can be independently and selectively electrically coupled to ground to steer the transmit antenna radiation pattern in different directions. (The antenna-radiation-pattern shapers may be different from the directors and the reflectors discussed previously.) Thus, if one or more antennas 920 includes N antenna-radiation-pattern shapers, the one or more antennas 920 may have $2^N$ different antenna-radiation-pattern configurations. More generally, a given antenna radiation pattern may include amplitudes and/or phases of signals that specify a direction of the main or primary lobe of the given antenna radiation pattern, as well as so-called 'exclusion regions' or 'exclusion zones' (which are sometimes referred to as 'notches' or 'nulls'). Note that an exclusion zone of the given antenna radiation pattern includes a low-intensity region of the given antenna radiation pattern. While the intensity is not necessarily zero in the exclusion zone, it may be below a threshold, such as 4 dB or lower than the peak gain of the given antenna radiation pattern. Thus, the given antenna radiation pattern may include a local maximum (e.g., a primary beam) that directs gain in the direction of an electronic device that is of interest, and one or more local minima that reduce gain in the direction of other electronic devices that are not of interest. In this way, the given antenna radiation pattern may be selected so that communication that is undesirable (such as with the other electronic devices) is avoided to reduce or eliminate adverse effects, such as interference or crosstalk.

Networking subsystem 914 includes processors, controllers, radios/antennas, sockets/plugs, and/or other devices used for coupling to, communicating on, and handling data and events for each supported networking system. Note that mechanisms used for coupling to, communicating on, and handling data and events on the network for each network system are sometimes collectively referred to as a 'network interface' for the network system. Moreover, in some embodiments a 'network' or a 'connection' between the electronic devices does not yet exist. Therefore, electronic device 900 may use the mechanisms in networking subsystem 914 for performing simple wireless communication between the electronic devices, e.g., transmitting frames and/or scanning for frames transmitted by other electronic devices.

Within electronic device 900, processing subsystem 910, memory subsystem 912, and networking subsystem 914 are coupled together using bus 928. Bus 928 may include an electrical, optical, and/or electro-optical connection that the subsystems can use to communicate commands and data among one another. Although only one bus 928 is shown for clarity, different embodiments can include a different number or configuration of electrical, optical, and/or electro-optical connections among the subsystems.

In some embodiments, electronic device 900 includes a display subsystem 926 for displaying information on a display, which may include a display driver and the display, such as a liquid-crystal display, a multi-touch touchscreen, etc.

Electronic device 900 can be (or can be included in) any electronic device with at least one network interface. For example, electronic device 900 can be (or can be included in): a desktop computer, a laptop computer, a subnotebook/netbook, a server, a computer, a mainframe computer, a cloud-based computer, a tablet computer, a smartphone, a cellular telephone, a smartwatch, a consumer-electronic device, a portable computing device, an access point, a transceiver, a controller, a radio node, a router, a switch, communication equipment, an access point, test equipment, and/or another electronic device.

Although specific components are used to describe electronic device 900, in alternative embodiments, different components and/or subsystems may be present in electronic device 900. For example, electronic device 900 may include one or more additional processing subsystems, memory subsystems, networking subsystems, and/or display subsystems. Additionally, one or more of the subsystems may not be present in electronic device 900. Moreover, in some embodiments, electronic device 900 may include one or more additional subsystems that are not shown in FIG. 9. Also, although separate subsystems are shown in FIG. 9, in some embodiments some or all of a given subsystem or component can be integrated into one or more of the other subsystems or component(s) in electronic device 900. For example, in some embodiments program instructions 922 is included in operating system 924 and/or control logic 916 is included in interface circuit 918.

Moreover, the circuits and components in electronic device 900 may be implemented using any combination of analog and/or digital circuitry, including: bipolar, PMOS and/or NMOS gates or transistors. Furthermore, signals in these embodiments may include digital signals that have approximately discrete values and/or analog signals that have continuous values. Additionally, components and circuits may be single-ended or differential, and power supplies may be unipolar or bipolar.

An integrated circuit (which is sometimes referred to as a 'communication circuit' or a 'means for communication') may implement some or all of the functionality of networking subsystem 914. The integrated circuit may include hardware and/or software mechanisms that are used for transmitting wireless signals from electronic device 900 and receiving signals at electronic device 900 from other electronic devices. Aside from the mechanisms herein described, radios are generally known in the art and hence are not described in detail. In general, networking subsystem 914 and/or the integrated circuit can include any number of radios. Note that the radios in multiple-radio embodiments function in a similar way to the described single-radio embodiments.

In some embodiments, networking subsystem 914 and/or the integrated circuit include a configuration mechanism (such as one or more hardware and/or software mechanisms) that configures the radio(s) to transmit and/or receive on a given communication channel (e.g., a given carrier frequency). For example, in some embodiments, the configuration mechanism can be used to switch the radio from monitoring and/or transmitting on a given communication channel to monitoring and/or transmitting on a different communication channel. (Note that 'monitoring' as used herein comprises receiving signals from other electronic devices and possibly performing one or more processing operations on the received signals)

In some embodiments, an output of a process for designing the integrated circuit, or a portion of the integrated circuit, which includes one or more of the circuits described herein may be a computer-readable medium such as, for example, a magnetic tape or an optical or magnetic disk. The computer-readable medium may be encoded with data structures or other information describing circuitry that may be physically instantiated as the integrated circuit or the portion of the integrated circuit. Although various formats may be used for such encoding, these data structures are commonly written in: Caltech Intermediate Format (CIF), Calma GDS II Stream Format (GDSII) or Electronic Design Interchange Format (EDIF). Those of skill in the art of integrated circuit design can develop such data structures from schematics of the type detailed above and the corresponding descriptions and encode the data structures on the computer-readable medium. Those of skill in the art of integrated circuit fabrication can use such encoded data to fabricate integrated circuits that include one or more of the circuits described herein.

While the preceding discussion used Wi-Fi and/or Ethernet communication protocols as illustrative examples, in other embodiments a wide variety of communication protocols and, more generally, communication techniques may be used. Thus, the communication techniques may be used in a variety of network interfaces. Furthermore, while some of the operations in the preceding embodiments were implemented in hardware or software, in general the operations in the preceding embodiments can be implemented in a wide variety of configurations and architectures. Therefore, some or all of the operations in the preceding embodiments may be performed in hardware, in software or both. For example, at least some of the operations in the communication techniques may be implemented using program instructions 922, operating system 924 (such as a driver for interface circuit 918) or in firmware in interface circuit 918. Alternatively or additionally, at least some of the operations in the communication techniques may be implemented in a physical layer, such as hardware in interface circuit 918.

Moreover, while the preceding embodiments illustrated the use of wireless signals in one or more bands of frequencies, in other embodiments of these signals may be communicated in one or more different bands of frequencies, including: a microwave frequency band, a radar frequency band, 900 MHz, 2.4 GHz, 5 GHz, 6 GHz, 60 GHz, and/or a band of frequencies used by a Citizens Broadband Radio Service or by LTE. In some embodiments, the communication between electronic devices uses multi-user transmission (such as orthogonal frequency division multiple access or OFDMA).

Furthermore, while the preceding embodiments illustrated the communication techniques with an access point, in other embodiments the communication techniques may be used with a wide variety of electronic devices, including: a desktop computer, a laptop computer, a subnotebook/netbook, a server, a computer, a mainframe computer, a cloud-based computer, a tablet computer, a smartphone, a cellular telephone, a smartwatch, a consumer-electronic device, a portable computing device, a transceiver, a controller, a radio node (e.g., an eNodeB), a router, a switch, communication equipment, a base station, test equipment, and/or another electronic device.

In the preceding description, we refer to 'some embodiments.' Note that 'some embodiments' describes a subset of all of the possible embodiments, but does not always specify the same subset of embodiments. Moreover, note that numerical values in the preceding embodiments are illustrative examples of some embodiments. In other embodiments of the communication techniques, different numerical values may be used.

The foregoing description is intended to enable any person skilled in the art to make and use the disclosure, and is provided in the context of a particular application and its requirements. Moreover, the foregoing descriptions of embodiments of the present disclosure have been presented for purposes of illustration and description only. They are not intended to be exhaustive or to limit the present disclosure to the forms disclosed. Accordingly, many modifications and variations will be apparent to practitioners skilled in the art, and the general principles defined herein may be applied to other embodiments and applications without departing from the spirit and scope of the present disclosure. Additionally, the discussion of the preceding embodiments is not intended to limit the present disclosure. Thus, the present disclosure is not intended to be limited to the embodiments shown, but is to be accorded the widest scope consistent with the principles and features disclosed herein.

What is claimed is:

1. An electronic device, comprising:

an interface circuit; and an antenna, communicatively coupled to the interface circuit, comprising a radiator, and multiple pairs of reflectors arranged along different axes passing through the radiator in a horizontal plane, wherein a given pair of reflectors comprises reflectors on opposite sides of the radiator and along a given axis, and wherein the interface circuit is configured to:

provide control signals to switching elements that selectively electrically couple the one or more of the reflectors to ground, wherein the one or more of the reflectors modify an antenna radiation pattern of the radiator; and communicate, via the antenna, a packet or a frame with a second electronic device, wherein the communication comprises transmitting or receiving wireless signals corresponding to the packet or the frame; and wherein the antenna is configured to operate in two or more bands of frequencies, and a first subset the pairs of reflectors are configured to modify the antenna radiation pattern in a first band of frequencies in the two or more bands of frequencies and a second subset the pairs of reflectors are configured to modify the antenna radiation pattern in a second band of frequencies in the two or more bands of frequencies.

2. The electronic device of claim 1, wherein the electronic device comprises an access point.

3. The electronic device of claim 1, wherein a given reflector is tuned to a lower frequency than the radiator; and wherein, when the given reflector is selectively electrically coupled to ground, the given reflector is configured to reflect the wireless signals in order to modify the antenna radiation pattern.

4. The electronic device of claim 1, wherein the antenna comprises at least two pairs of reflectors.

5. The electronic device of claim 1, wherein the electronic device comprises multiple pairs of directors arranged along the different axes;

wherein a given pair of directors comprises directors on opposite sides of the radiator along the given axis and distal to the given pair of reflectors;

wherein the interface circuit is configured to provide second control signals to second switching elements that selectively electrically couple the one or more of the directors to ground;

wherein the one or more of the directors modify the antenna radiation pattern of the radiator; and wherein the packet or frame is communicated, via the antenna, using the modified antenna radiation pattern.

6. The electronic device of claim 5, wherein a given director is tuned to a higher frequency than the radiator; and wherein, when the given director is selectively electrically decoupled to ground, the given director is configured to re-radiate the wireless signals in order to modify the antenna radiation pattern.

7. The electronic device of claim 5, wherein the antenna comprises at least two pairs of reflectors and at least two pairs of directors.

8. The electronic device of claim 1, wherein the antenna is disposed on a substrate.

9. The electronic device of claim 1, wherein the modified antenna radiation pattern is more directional than the antenna radiation pattern of the radiator.

10. The electronic device of claim 1, wherein the radiator comprises a monopole or a dipole.

11. The electronic device of claim 1, wherein the switching elements comprise a PIN diode or a radio-frequency switch.

12. The electronic device of claim 1, wherein the interface circuit is configured to receive, at the antenna, feedback about communication of the packet or the frame associated with the second electronic device; and wherein the modified antenna radiation pattern is based at least in part on the feedback.

13. The electronic device of claim 1, wherein the antenna comprises multiple antennas or multiple antenna elements having different predefined polarizations, and the interface circuit is configured to dynamically select the antennas or the antenna elements to adjust a polarization of the wireless signals.

14. The electronic device of claim 13, wherein the interface circuit is configured to adjust the polarization of the wireless signals by changing a relative phase of electrical signals provided to at least some of the antennas.

15. The electronic device of claim 13, wherein the interface circuit is configured to receive, at one or more of the antennas or the antenna elements, feedback about communication of the packet or the frame associated with the second electronic device; and wherein the dynamic adjusting of the polarization is based at least in part on the feedback.

16. The electronic device of claim 1, wherein the modified antenna radiation pattern is based at least in part on a deployment geometry of the electronic device.

17. A method for communicating a packet or a frame, comprising:

by an electronic device:

modifying an antenna radiation pattern of an antenna, wherein the antenna comprises a radiator and multiple pairs of reflectors arranged along different axes passing through the radiator in a horizontal plane, wherein a given pair of reflectors comprises reflectors on opposite sides of the radiator and along a given axis, and wherein modifying the antenna radiation pattern comprises selectively electrically coupling one or more of the reflectors to ground; and communicating, via the antenna, the packet or the frame with a second electronic device, wherein the communication comprises transmitting or receiving wireless signals corresponding to the packet or the frame; and wherein the antenna operates in two or more bands of frequencies, and a first subset the pairs of reflectors modify the antenna radiation pattern in a first band of frequencies in the two or more bands of frequencies and a second subset the pairs of reflectors modify the antenna radiation pattern in a second band of frequencies in the two or more bands of frequencies.

18. The method of claim 17, wherein the antenna comprises at least two pairs of reflectors.

19. The method of claim 17, wherein the modified antenna radiation pattern is based at least in part on a deployment geometry of the electronic device.

* * * * *